US006131002A

United States Patent [19]

Gibson et al.

[11] Patent Number: 6,131,002

[45] Date of Patent: Oct. 10, 2000

[54] SYSTEMS AND METHODS FOR CONTROLLING TONER CONCENTRATION BY SENSING RESIDUAL POTENTIAL

[75] Inventors: George A. Gibson, Fairport, N.Y.; Robert M. Simms, Morgan Hill, Calif.

[73] Assignee: Xerox Corporation, Stamford, Conn.

[21] Appl. No.: 09/282,207

[22] Filed: Mar. 31, 1999

[51] Int. Cl.[7] ..... G03G 15/08; G03G 15/10

[52] U.S. Cl. ..... 399/57; 399/58

[58] Field of Search ..... 399/57, 58, 60, 399/237, 238

[56] References Cited

FOREIGN PATENT DOCUMENTS 61-179480 8/1986 Japan .

4-199079 7/1992 Japan .

*Primary Examiner*—Quana M. Grainger

*Attorney, Agent, or Firm*—Oliff & Berridge, PLC

[57] ABSTRACT

A technique for detecting the toner solids concentration of a liquid toner uses electrostatic sensing and avoids reliance on optical transmission paths, which tend to clog and lead to undertoning or overtoning. The toner solids concentration is instead detected by measuring the residual electric potential of a developed area on an image bearing member. The residual electric potential has been discovered to correlate well with the toner solids concentration.

48 Claims, 7 Drawing Sheets

SYSTEMS AND METHODS FOR CONTROLLING TONER CONCENTRATION BY SENSING RESIDUAL POTENTIAL

BACKGROUND OF THE INVENTION

1. Field of Invention

This invention is related to developing latent electrostatic images using liquid toners. More particularly, this invention is directed to techniques for accurately determining a concentration of the toner solids in the liquid carrier material in a liquid toner composition.

2. Description of Related Art

In liquid-toner xerographic printing engines, the developed toner mass has been shown, both theoretically and experimentally, to depend on the toner solids concentration. Producing acceptable print densities that do not vary widely with varying toner solids concentrations requires maintaining the toner solids concentration in the flat part of the density vs. developed mass curve. Therefore, accurately measuring the toner solids concentration is critical to ensuring proper print densities and print quality.

SUMMARY OF THE INVENTION

Currently, the toner solids concentration is typically controlled by measuring the transmission optical density of the working toner dispersion, using infrared or other light emitters. The emitted light is in part absorbed by the toner solids. Based on the measured transmission optical density, liquid carrier material or toner solids are added to the liquid toner reservoir to maintain the toner solids concentration in the liquid toner within a desired range. Working toner dispersions have high extinction coefficients. That is, the rate of absorption of light in these working toner dispersions is very high. Thus, the measurement chambers used for measuring the transmission optical density of the working toner dispersion must have extremely short path lengths.

Because the measurement chambers have short path lengths, the measurement chambers have a tendency to clog with toner solids. Clogging of the measurement chambers causes inaccurate toner solids concentration measurements, which ultimately cause either overtoning or undertoning, and thus requires a service call.

As is well known in the art, fluid flows past walls causes an electric potential difference, known as the streaming potential, to form between the walls and the fluid. In particular, in liquid toner development systems, a streaming potential forms between the walls of the measurement chambers, which are typically plastic, and the toner solids in the working toner dispersions. Because the working toner dispersions are generally insulative, this streaming potential generally cannot dissipate. Accordingly, the toner particles in the working toner dispersions adhere to the walls, including the optical windows, of the measurement chambers due to the streaming potential generated when the insulative liquid toner flows through the measurement chambers.

The adhered toner solids act both to clog the measurement chambers and to obscure the optical windows into the measurement chambers. Moreover, the adhered toner solids generally do not dissipate, but tend to accumulate. All of these effects further degrade the accuracy of the toner solids concentration measurements and the ability to control the toner solids concentration. For these reasons, the optical sensors used for measuring the toner solids concentration are often the least reliable component in the toner control system.

This invention provides systems and methods for controlling the toner solids concentration.

This invention separately provides systems and methods for controlling toner solids concentrations by sensing the residual electric potential on the photoreceptor after a latent image has been developed.

In contrast to optical measurement techniques, electrical measurement techniques according to the systems and methods of this invention that are not susceptible to the problems outlined above can be used to determine the toner solids concentration of the liquid toner. These electrical measurement techniques measure properties associated with the latent image bearing member, such as a recording medium or a photoreceptor, on which the latent image to be developed by the liquid toner is formed. Because the latent image bearing member is open and exposed, the problems associated with the enclosed optical measurement chambers are avoided.

The systems and methods according to this invention take advantage of the discovery that the residual electric potential on the latent image bearing member remaining after the latent image is developed changes with changes in the reflective optical density of the developed image and that the reflective optical density varies with variations in the toner solids concentration. More accurately, the developed toner potential, which is the difference between the original latent image electric potential before development and the residual electric potential remaining after development, varies with changes in the reflective optical density of the developed image. Because the changes in the developed toner potential are highly correlated to the changes in the reflective optical density, and the reflective optical density follows the toner solids concentration, measuring the residual electric potential allows the toner solids concentration to be determined independently of the transmission optical density of the liquid toner.

These and other features and advantages of this invention are described in or are apparent from the following detailed description of the preferred embodiments.

BRIEF DESCRIPTION OF THE DRAWINGS

The invention will be described with reference to the accompanying drawings, in which like elements are labeled with like numbers, and in which.

DETAILED DESCRIPTION OF PREFERRED EMBODIMENTS

Aspects of the environment in which the systems and methods according to this invention operate are generally described, for instance, in copending U.S. applications Ser. Nos. 09/083,114; 09/083,202; and 09/083,203, each of which is incorporated herein by reference in its entirety.

Figure 1:
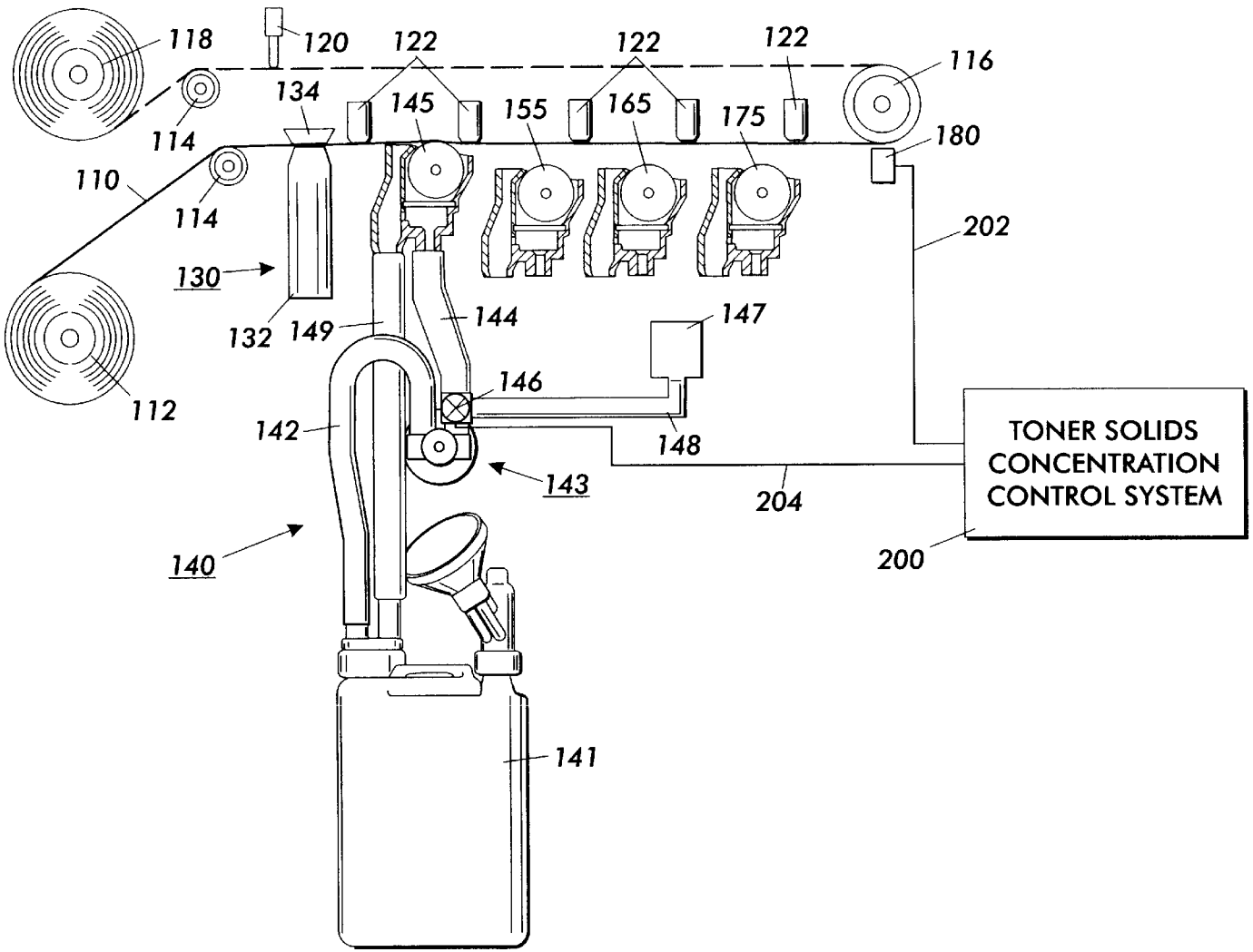
FIG. 1 shows one exemplary embodiment of an image reproduction system according to this invention.

FIG. 1 shows an image reproduction system 100 that uses liquid toners to develop electrostatic latent images formed on a latent image bearing member. In particular, the image reproduction system 100 shown in FIG. 1 includes a four-color ionographic liquid toner print engine. However, it should be appreciated that the toner concentration control systems and methods of this invention can equally be applied to any other type of print engines that generate electrostatic latent images and use liquid toners to develop the generated electrostatic latent images. These other types of print engines include laser printers and full width light emitting element print bars that include photoreceptors, raster output scanner printers, analog copiers and digital copiers that include photoreceptor belts or drums, and any other known or later developed single-color, highlight-color or full-color xerographic or ionographic print engines, or any other known or later developed electrostatic latent image forming print engine.

As shown in FIG. 1, the ionographic image reproduction system 100 includes a latent image bearing member 110. In the ionographic image reproduction system 100 shown in FIG. 1, the image bearing member 110 is a long sheet of media carried on a media supply roll 112. The media sheet 110 passes by a writing station 130 and one or more developing stations, travels around a number of guide rollers 114, a drive roller 116 and a media take-up roller 118. The media sheet 110 also passes by a cutter 120.

The writing station 130 of the ionographic image reproduction system 100 includes a writing head 132 and a backplate electrode 134. The writing head 132 includes a large number of needle-like emitting members that apply an electrostatic charge to the latent image bearing media sheet 110. In particular, voltages applied to the backplate electrode 134 and to each of the needle-like emitting members of the writing head 132 are controlled to selective apply electrostatic charges to the latent image bearing media sheet 110 to directly form the electrostatic latent image on the latent image bearing media sheet 110. The portion of the latent image bearing media sheet 110 carrying the electrostatic latent image travels from the writing station 130 to a first developing station 140. After passing through the first developing station 140, in the four-color ionographic image reproduction system 100 shown in FIG. 1, the portion of the latent image bearing media sheet 110 carrying the electrostatic latent image then travels to three additional developing stations and then past a residual electric potential sensor 180. In contrast, in a single-color ionographic image reproduction system, the portion of the latent image bearing media sheet 110 carrying the electrostatic latent image would then pass directly from the first developing station 140 to the residual electric potential sensor 180.

The residual electric potential sensor 180 senses the residual electric potential remaining on a portion of the latent image bearing member 110 after the latent image within that portion has been developed using the liquid toners. That is, the latent image, when formed on the latent image bearing member 110, has an original latent image potential. That original latent image potential has a given electric polarity and attracts toner solids having the opposite electric polarity that are suspended in the liquid toner. The toner solids are attracted to a particular pixel area of the latent image based on the strength of the original latent image potential of that particular pixel area, and adhere to the latent image bearing member 110 to develop the latent image. In particular, the toner solids, because they have the opposite polarity of the latent image, cause some, but not all, of the original latent image potential of the latent image to dissipate. The remaining, undissipated electric potential of the latent image is the residual electric potential. The difference between the original latent image potential and the residual electric potential is called the developed toner potential, and is equal to the amount of original latent image potential dissipated in developing the latent image.

In FIG. 1, only the first developing station 140, and the rotary liquid toner fountains 155, 165 and 175 of the other three developing stations, have been shown. It should be appreciated that each of the other three developing stations has a structure identical to that of the first developing station. As shown in FIG. 1, the first developing station 140 includes a liquid toner reservoir 141, a first supply line 142 that connects the liquid toner reservoir 141 to a liquid toner pump 143, and a second supply line 144 that connects the liquid toner pump 143 to the rotary liquid toner fountain 145 and that contains an electronically-controlled toner solids addition valve 146. A toner solids concentrate supply tank 147 is connected by a toner solids supply line 148 to the toner solids addition valve 146. The rotary liquid toner fountain 145 returns any unused liquid toner, supplied by the liquid toner pump 143 through the second supply line 144, to the liquid toner reservoir 141 through a return line 149.

As shown in FIG. 1, a toner solids concentration control system 200 is connected over a signal line 202 to the residual electric potential sensor 180 and over a signal line 204 to the electronically-controlled toner solids addition valve 146.

Figure 2:
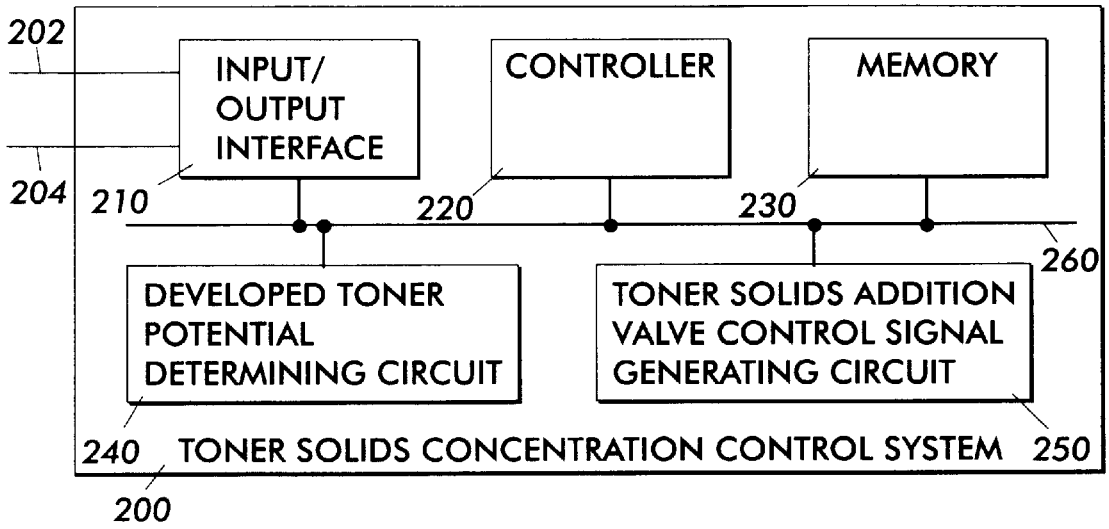
FIG. 2 is a functional block diagram of one exemplary embodiment of the toner solids concentration control system of FIG. 1 according to this invention.

FIG. 2 is a block diagram showing in greater detail one exemplary embodiment of the toner solids concentration control system 200. As shown in FIG. 2, the toner solids concentration control system 200 includes an input/output interface 210 connected to the signal lines 202 and 204, a controller 220, a memory 230, a developed toner potential determining circuit 240, and a toner solids addition valve control signal generating circuit 250, all interconnected by a data and/or control signal bus 260. The input/output interface 210, under control of the controller 220, inputs the sensed residual electric potential on the latent image bearing member 110 and stores the sensed residual electric potential in the memory 230. The memory 230 includes an alterable portion and may contain a fixed portion. The memory 230 also stores any necessary control programs and either a nominal or a sensed value of the original latent image potential applied to the latent image bearing member 110 by the writing head 132.

In particular, the residual electric potential sensor 180 will output one value of the sensed residual electric potential for each different color liquid toner used by the image reproduction system 100. In one exemplary embodiment, the residual electric potential of each different color liquid toner is determined by printing a test patch of each color toner onto the latent image bearing member 110. Each test patch has a predetermined density. Accordingly, each test patch has a predetermined original latent image potential.

The developed toner potential determining circuit 240 inputs the values of the sensed residual electric potential and the original latent image potential for each different color toner to determine the developed toner potential for each different color toner. In particular, for each different color toner, the developed toner potential is determined as the difference between the sensed residual electric potential and the original latent image potential for that color toner. The developed toner potential determining circuit 240 outputs the determined developed toner potential for each different color toner to the memory 230, or directly to the toner solids addition valve control signal generating circuit 250.

As shown in FIG. 2, the toner solids addition valve control signal generating circuit 250 inputs the determined developed toner potential either from the memory 230 or directly from the developed toner potential determining circuit 240. The toner solids addition valve control signal generating circuit 260 compares the determined developed toner potential for that color toner with a threshold developed toner potential value to directly determine the amount of toner solids to be added from the developed toner potential. If the determined developed toner potential for that color toner is at or above the threshold developed toner potential value, the toner solids addition valve control signal generating circuit 250 does not generate a toner solids addition valve control signal. In this case, the toner solids addition valve 146 does not add any toner solids to the liquid toner.

In contrast, if the determined developed toner potential for that color toner is below the threshold developed toner potential value, the toner solids addition valve control signal generating circuit 250 generates a toner solids addition valve control signal to add toner solids to the liquid toner. In particular, the toner solids addition valve control signal generated by the toner solids addition valve control signal generating circuit 250 will control the toner solids addition valve 146 to add an amount of toner solids to the liquid toner that is a function of a predetermined relationship between the determined developed toner potential and a corresponding actual toner solids concentration for that color toner and is also proportional to the amount that the determined developed toner potential is below the threshold developed toner potential value.

In one exemplary embodiment, the toner solids addition valve control signal generating circuit 250 is implemented using a lookup table that stores the toner solids addition value control signal value as its output, with the determined developed toner potential for that color toner used as the address to the lookup table. In a second exemplary embodiment, the toner solids addition valve control signal generating circuit 250 is implemented as a circuit that embodies a predetermined mathematical relationship that converts the determined developed toner potential into a corresponding toner solids addition value control signal value for that color toner. In general, the predetermined relationship between the determined developed toner potential and the corresponding toner solids addition value control signal value for that color toner will generally be determined empirically for each different model of an image reproduction system, and may need to be empirically modified for each particular image reproduction system.

In one exemplary embodiment, to increase the amount of toner solids added to the liquid toner based on the amount that the determined developed toner potential is below the threshold developed toner potential value, the toner solids addition valve control signal is generated either to open the toner solids addition valve 146 to a greater degree, or to open the toner solids addition valve 146 for a longer interval. In a second exemplary embodiment, the toner solids addition valve control signal generating circuit 250 will output a toner solids addition valve control signal to the toner solids addition valve 146 to add a fixed amount of toner solids to the liquid toner.

In operation, the image reproduction system 100, having the toner solids concentration control system 200, generates a number of images on the latent image bearing member 110 and outputs the generated images to the user on either the latent image bearing member 110 or on a separate image receiving member. After a predetermined number of images have been created, a test patch having a known latent image density is formed on the latent image bearing member 110.

Optionally, the original latent image potential can be measured using a second electric potential sensor (not shown) that is positioned upstream of the image developing stations. If the original latent image potential is measured using the second electric potential sensor, the measured original latent image potential of the test patch is input to the toner solids concentration control system 200 through the input/output interface 210 and stored in the memory 230. Otherwise, if the original latent image potential is not measured using a second electric potential sensor, the memory is supplied with a value representing the nominal original latent image potential that is assumed to have been applied to the latent image bearing member 110.

In either case, the test patch is then developed using one of the different color liquid toners. The residual electric potential remaining on the developed test patch is sensed using the residual electric potential sensor 180, and a signal representing the sensed residual electric potential is output by the residual electric potential sensor 180 to the toner solids concentration control system 200 through the input/output interface 210. It should be appreciated that the residual electric potential for each different color must be measured, so that the toner solids concentration for each different liquid toner can be controlled.

In one exemplary embodiment, the writing station 130 forms a series of separate test patches arranged along the direction of travel of the latent image bearing member 110. In this exemplary embodiment, the residual electric potential sensor 180 needs to have only a single sensing element. Each test patch is in turn developed and sensed by the residual electric potential sensor 180. If the latent image bearing member 110 is not reusable, this exemplary embodiment consumes a large amount of the latent image bearing member 110. It should be appreciated that any other known or later-developed systems and methods for generating the different color test patches and measuring the residual electric potential of each test patch can be used in the systems and methods of this invention.

The sensed residual electric potential value is then either stored in the memory 230 and then output to the developed toner potential determining circuit 240, or input directly to the developed toner potential determining circuit 240. The developed toner potential determining circuit 240 inputs the sensed residual electric potential value and either the sensed or nominal original latent image potential value from the memory 230 and determines the developed toner potential as the difference between the sensed or nominal original latent image potential value and the sensed residual electric potential value.

The determined developed toner potential is then output to the toner solids addition valve control signal generating circuit 250, as discussed above. The toner solids addition valve control signal generating circuit 250 determines the toner solids addition valve control signal by directly converting the developed toner potential value to the toner solids addition valve control signal, using either a lookup table or a circuit that implements a predetermined mathematical relationship, as discussed above. The lookup table and the predetermined mathematical relationship are determined using the relationships between the developed toner potential value, the reflective optical density value and the current toner concentration value outlined in FIGS. 4 and 5 and discussed in greater detail below. In addition, the comparison operation is implemented by having zero outputs from the lookup table or a circuit for determined developed toner potential values that are above the threshold developed toner potential value.

Alternatively, in a second exemplary embodiment, the toner solids addition valve control signal generating circuit 250 determines the toner solids addition valve control signal using a set of lookup tables or a set of circuits that each implement a predetermined mathematical relationship. In this case, one of the set implements the relationship between the developed toner potential value and the reflective optical density value shown in FIG. 4 and the comparison operation. A second one of the set implements the relationship between the reflective optical density value and the current toner concentration value shown in FIG. 5. A third one of the set implements a predetermined relationship between the determined current toner concentration value and the toner solids addition valve control signal to be output to the toner solids addition valve.

Figure 3:
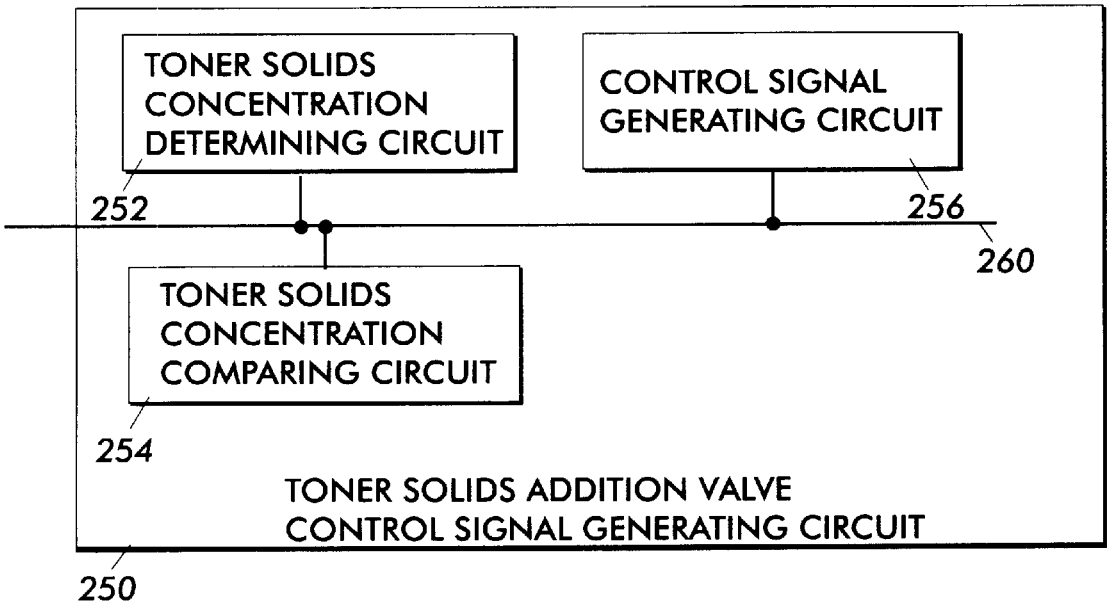
FIG. 3 is a functional block diagram of a second exemplary embodiment of the toner addition valve control signal generating circuit shown in FIG. 2.

FIG. 3 shows in greater detail a second exemplary embodiment of the toner solids addition valve control signal generating circuit 250. As shown in FIG. 3, in the second exemplary embodiment of the toner solids addition valve control signal generating circuit 250, the toner solids addition valve control signal generating circuit 250 includes a toner solids concentration determining circuit 252, a toner solids concentration comparing circuit 254 and a control signal generating circuit 256. In this second exemplary embodiment of the toner solids addition valve control signal generating circuit 250, the toner solids addition valve control signal generating circuit 250 does not directly convert the developed toner potential to the toner solids addition valve control signal. Rather, the toner solids concentration determining circuit 252 inputs the determined developed toner potential either from the memory 230 or directly from the developed toner potential determining circuit 240.

The toner solids concentration determining circuit 252 determines, for each different color toner, the current toner solids concentration in the corresponding liquid toner reservoir based on the determined developed toner potential for that color toner and a predetermined relationship between the determined developed toner potential for that color toner and the current toner solids concentration for that color toner. In one exemplary embodiment, the toner solids concentration determining circuit 252 is implemented using a lookup table that stores the predetermined relationship as its output, with the determined developed toner potential for that color toner used as the address to the lookup table.

In a second exemplary embodiment, the toner solids concentration determining circuit 252 is implemented as a circuit that embodies a predetermined mathematical relationship that converts the determined developed toner potential into a corresponding current toner solids concentration for that color toner. In general, in this second exemplary embodiment, the predetermined mathematical relationship will generally be determined empirically for each different model of image reproduction system, and may need to be empirically modified for each particular image reproduction system.

The toner solids concentration comparing circuit 254 compares the determined current toner solids concentration for that color toner with a threshold toner solids concentration value, and outputs a comparison result to the control signal generating circuit 256. If the determined current toner solids concentration for that color toner is at or above the threshold toner solids concentration value, the control signal generating circuit 256 does not generate a toner solids addition valve control signal. In this case, the toner solids addition valve 146 does not add any toner solids to the liquid toner.

In contrast, if the determined current toner solids concentration for that color toner is below the threshold toner solids concentration value, the control signal generating circuit 256 generates a toner solids addition valve control signal to add toner solids to the liquid toner. In one exemplary embodiment, the toner solids addition valve control signal generated by the control signal generating circuit 256 will output a toner solids addition valve control signal to the toner solids addition valve 146 to add an amount of toner solids to the liquid toner that is proportional to the amount that the determined current toner solids concentration for that color toner is below the threshold toner solids concentration value. To increase the amount of toner solids added to the liquid toner, the toner solids addition valve control signal can either open the toner solids addition valve 146 to a greater degree, or open the toner solids addition valve 146 for a longer interval. In a second exemplary embodiment, the control signal generating circuit 256 will output a toner solids addition valve control signal to the toner solids addition valve 146 to add a fixed amount of toner solids to the liquid toner.

In operation of the second exemplary embodiment of the toner solids addition valve control signal generating circuit 250, the determined developed toner potential is input by the toner solids concentration determining circuit 252. In one exemplary embodiment, the toner solids concentration determining circuit 252 determines the current toner solids concentration using either a lookup table or a circuit that implements a predetermined mathematical relationship, as discussed above. The lookup table and the predetermined mathematical relationship are determined using the relationships between the developed toner potential value, the reflective optical density value and the current toner concentration value outlined in FIGS. 4 and 5 and discussed in greater detail below.

Alternatively, in a second exemplary embodiment, the toner solids concentration determining circuit 252 determines the current toner solids concentration using a pair of lookup tables or a pair of circuits that each implement a predetermined mathematical relationship. In this case, one of the pair implements the relationship between the developed toner potential value and the reflective optical density value shown in FIG. 4. The other of the pair implements the relationship between the reflective optical density value and the current toner concentration value shown in FIG. 5. Then, the determined current toner concentration value is compared by the toner solids concentration comparing circuit 254 to a threshold toner concentration value to determine if a toner solids addition valve control signal should be generated. If so, the determined current toner concentration value is input by the control signal generating circuit 256 to generate the toner solids addition valve control signal, as discussed above.

It should be understood that each of the circuits shown in FIGS. 2 and 3 can be implemented as portions of a suitably programmed general purpose microprocessor. Alternatively, each of the circuits shown in FIGS. 2 and 3 can be implemented as physically distinct hardware circuits within an ASIC, or using a FPGA, a PDL, a PLA or a PAL, or using discrete logic elements or discrete circuit elements. The particular form each of the circuits shown in FIGS. 2 and 3 will take is a design choice and will be obvious and predicable to those skilled in the art.

It should further be appreciated that one of ordinary skill in the art will recognize that other combinations of the developed toner potential determining circuit 240 and the toner solids addition valve control signal generating circuit 250 can also be used with the systems and methods of this invention. For example, if the nominal original latent image potential can be assumed to be a known fixed value, the developed toner potential determining circuit 240 can be omitted. In this case, the toner solids addition valve control signal generating circuit 250 can directly input the residual electric potential and generate the toner addition valve control signal based on the additional relationship between the residual electric potential and the developed toner potential based on the known fixed original latent image potential. Likewise, if the original latent image potential is measured, both the measured original latent image potential and the measured residual electric potential can be used directly by the toner solids addition valve control signal generating circuit 250 as input values to the lookup table or circuit described above. In this case, the lookup table or circuit will implement the additional relationship between the measured original latent image potential, the measured residual electric potential and the resulting developed toner potential.

Figure 4:
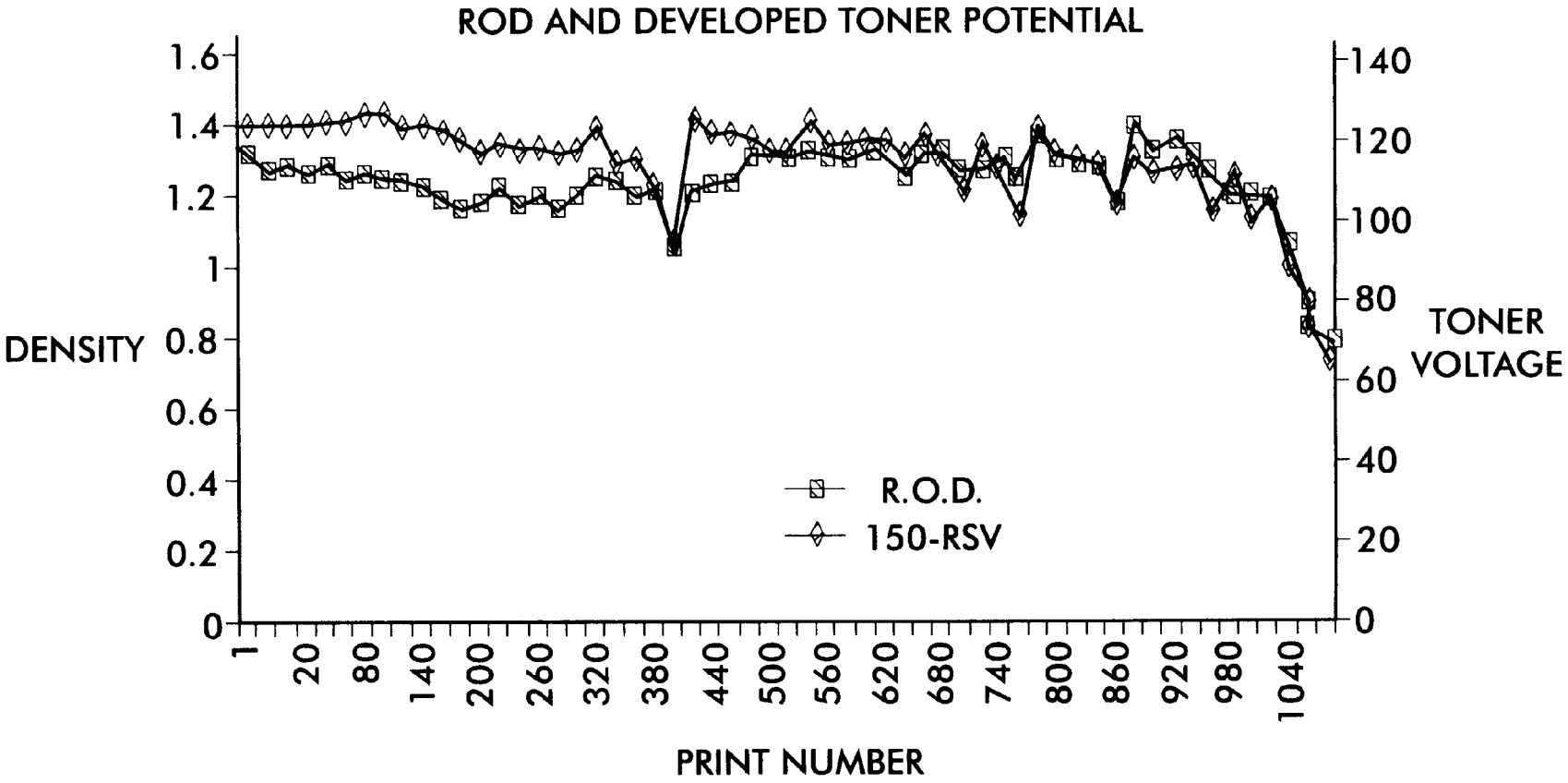
FIG. 4 is a graph illustrating the relationship between the measured reflective optical density (ROD) and the developed toner potential.

FIG. 4 is a graph illustrating the relationship between the measured reflective optical density (ROD) and the developed toner potential. In particular, as shown in FIG. 4, the reflective optical density (ROD) represents the amount of light reflected from the test patch. The reflective optical density (ROD) is directly related to the amount of toner that adhered to the test patch when the latent image of the test patch was developed. As outlined above, the developed toner potential is the difference between the original latent image potential and the residual potential. As shown in FIG. 4, the reflective optical density (ROD) and the developed toner potential are highly correlated. That is, as the reflective optical density (ROD) rises and falls, the developed toner potential rises and falls with the reflective optical density (ROD). Moreover, the developed toner potential rises and falls substantially in proportion with the reflective optical density (ROD).

Thus, FIG. 4 establishes that determining the developed toner potential is a sufficient substitute for measuring the reflective optical density (ROD). Additionally, the developed toner potential, as outlined above, is easily determined from the measured residual electric potential and a measured or nominal latent image potential. Furthermore, determining an electric property such as the residual electric potential is easier than measuring an optical property such as the reflective optical density (ROD).

Figure 5:
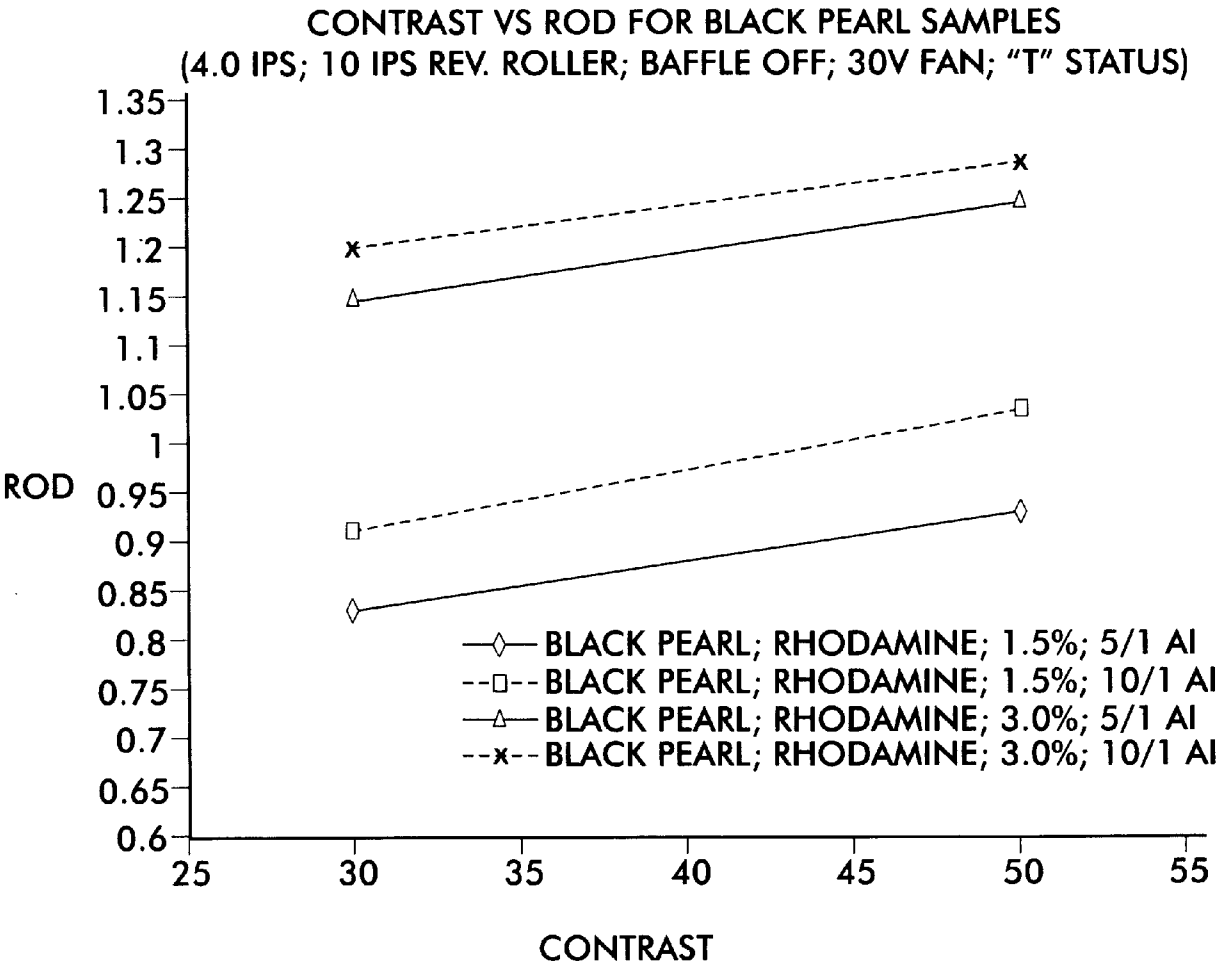
FIG. 5 is a graph illustrating the relationship between the measured reflective optical density and the toner solids concentration of the liquid toner.

FIG. 5 is a graph illustrating the relationship between the measured reflective optical density and the toner solids concentration of the liquid toner. In particular, as discussed above, the reflective optical density (ROD) is directly related to the amount of toner that adhered to the test patch when the latent image of the test patch was developed. The points plotted on the graph of FIG. 5 represent different toner concentration levels for two different toner compositions at two different contrast values. The contrast is a unitless value that represents the difference between the electric potential of a fully discharged latent image bearing member, and the electric potential, i.e., the original latent image potential, of a fully charged latent image bearing member.

Both toner compositions used to generate the graph of FIG. 5 include "black pearl" type carbon black and the magenta pigment "rhodamine". The toner composition represented by the diamond and triangle points in the graph of FIG. 5 has a ratio of 5 milligrams of charge director to 1 gram of toner solids (5/1 Al). In contrast, the toner composition represented by the square and star points in the graph of FIG. 5 has a ratio of 10 milligrams of charge director to 1 gram of toner solids (10/1 Al).

Most importantly for understanding the relationship between reflective optical density and toner solids concentration, the toner composition represented by the diamond and triangle points in the graph of FIG. 5 has nominal toner solids concentrations of 1.5% toner solids and 3.0% toner solids, respectively. Similarly, the toner composition represented by the square and star points in the graph of FIG. 5 has nominal toner solids concentrations of 1.5% toner solids and 3.0% toner solids, respectively.

As shown in FIG. 5, for contrast levels of both 30 and 50, the reflective optical density increases generally arithmetically with the percentage of toner solids in the toner composition. Additionally, as shown in FIG. 5, this increase occurs independently of the ratio of charge director to toner solids and independently of the contrast level. That is, as shown in FIG. 5, as the ratio of charge director to toner solids is increased, the increase in the reflective optical density at each contrast level for the toner compositions having 1.5% toner solids is generally the same as the increase in the reflective optical density at each contrast level for the toner compositions having 3.0% toner solids. Similarly, as the contrast level increases, the increase in the reflective optical density is generally the same at each toner solids concentration level and at each ratio of charge director to toner solids.

Accordingly, if each of the contrast level and the ratio of charge director to toner solids is known and stable, or is measurable, determining the reflective optical density according to a relationship between the developed toner potential and the reflective optical density, such as that shown in FIG. 4, should further identify the toner solids concentration according to a relationship between the reflective optical density and the toner solids concentration, such as that shown in FIG. 5.

Figure 6:
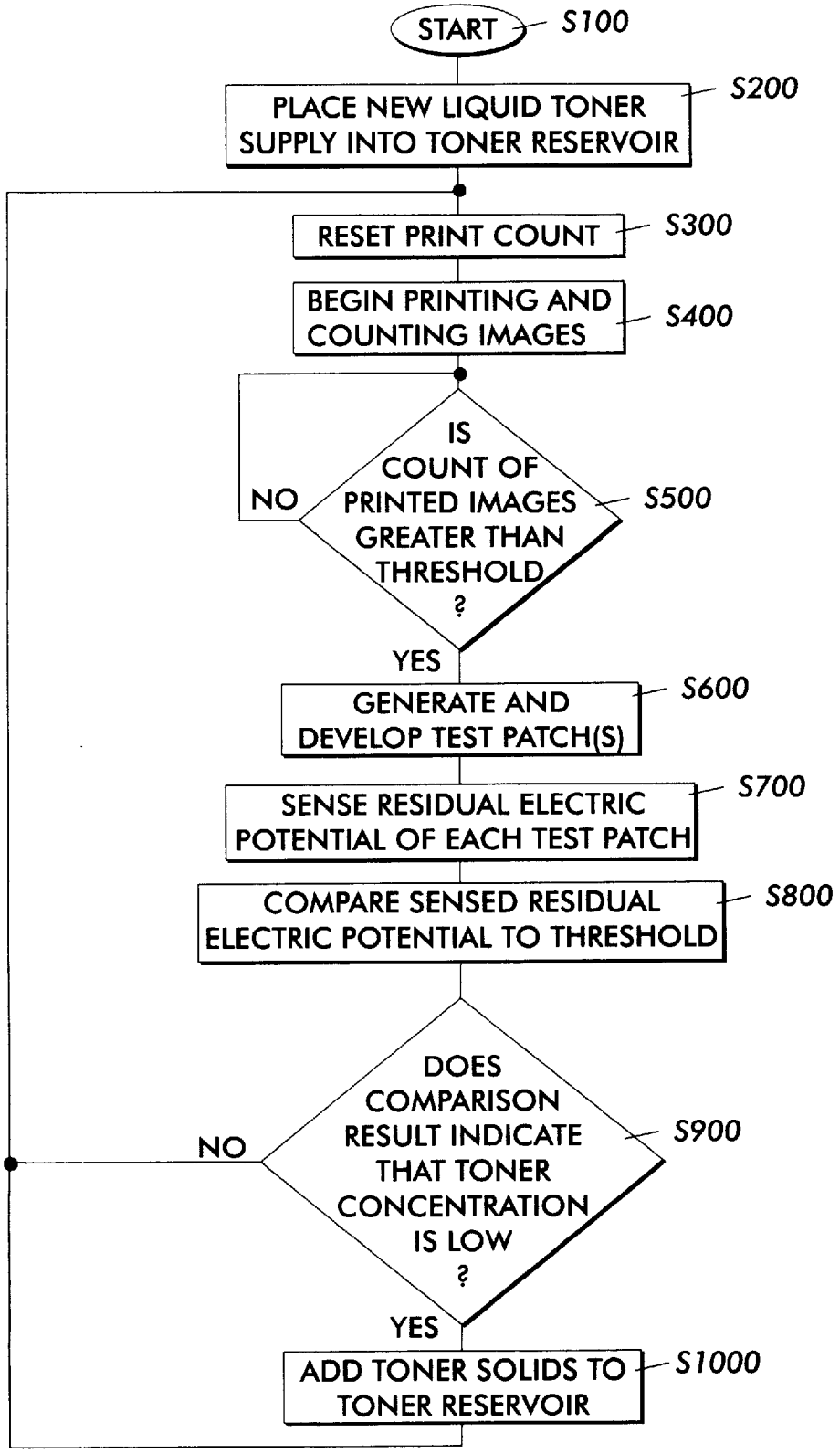
FIG. 6 is a flowchart outlining one exemplary embodiment of a method for controlling toner solids concentrations according to this invention.

FIG. 6 is a flowchart outlining one exemplary embodiment of a method for controlling toner solids concentrations according to this invention. In particular, as shown in FIG. 6, beginning in step S100, the control routine restarts each time the liquid toner in the liquid toner reservoir is completely replaced with a new supply of the liquid toner having the desired toner solids concentration. Thus, in step S200, the new liquid toner supply is placed into the liquid toner reservoir. Then, in step S300, a print count of the number of images printed is reset. Next, in step S400, the image reproduction system begins printing images on the latent image bearing member and the count of printed images is incremented by one each time a latent image is developed. Control then continues to step S500.

In step S500, the count of printed images is compared to a threshold. The threshold represents the interval, in number of printed images, between measurements of the residual electric potential of one or more test patches on the latent image bearing member. If the count of printed images is greater than the threshold, control continues to step S600. Otherwise, control jumps back to step S500 until the threshold is exceeded.

In step S600, one or more test patches are generated and developed on the latent image bearing member. Then, in step S700, the residual electric potential of each developed test patch is sensed. Next, in step S800, the sensed residual electric potential is compared to a threshold. Control then continues to step S900.

In step S900, the comparison result for each test patch is check to determine whether it indicates that the toner concentration for the corresponding liquid toner is low. If so, control continues to step S1000. Otherwise, control jumps back to step S200. In step S1000, for each liquid toner having a low toner solids concentration, toner solids are added to that liquid toner to raise the toner solids concentration. Control then also returns to step S200.

It should be appreciated that this process continues uninterrupted until the liquid toner supplies in the liquid toner reservoirs are all replaced with new liquid toner, even across print jobs, and even if the image reproduction system should be shut down or otherwise halted. It should also be appreciated that, in the flowchart shown in FIG. 6, the sensed residual electric potential can be compared directly to a residual electric potential threshold, or, as shown in FIGS. 7 and 8, the sensed residual electric potential can be converted as outlined above.

Figure 7:
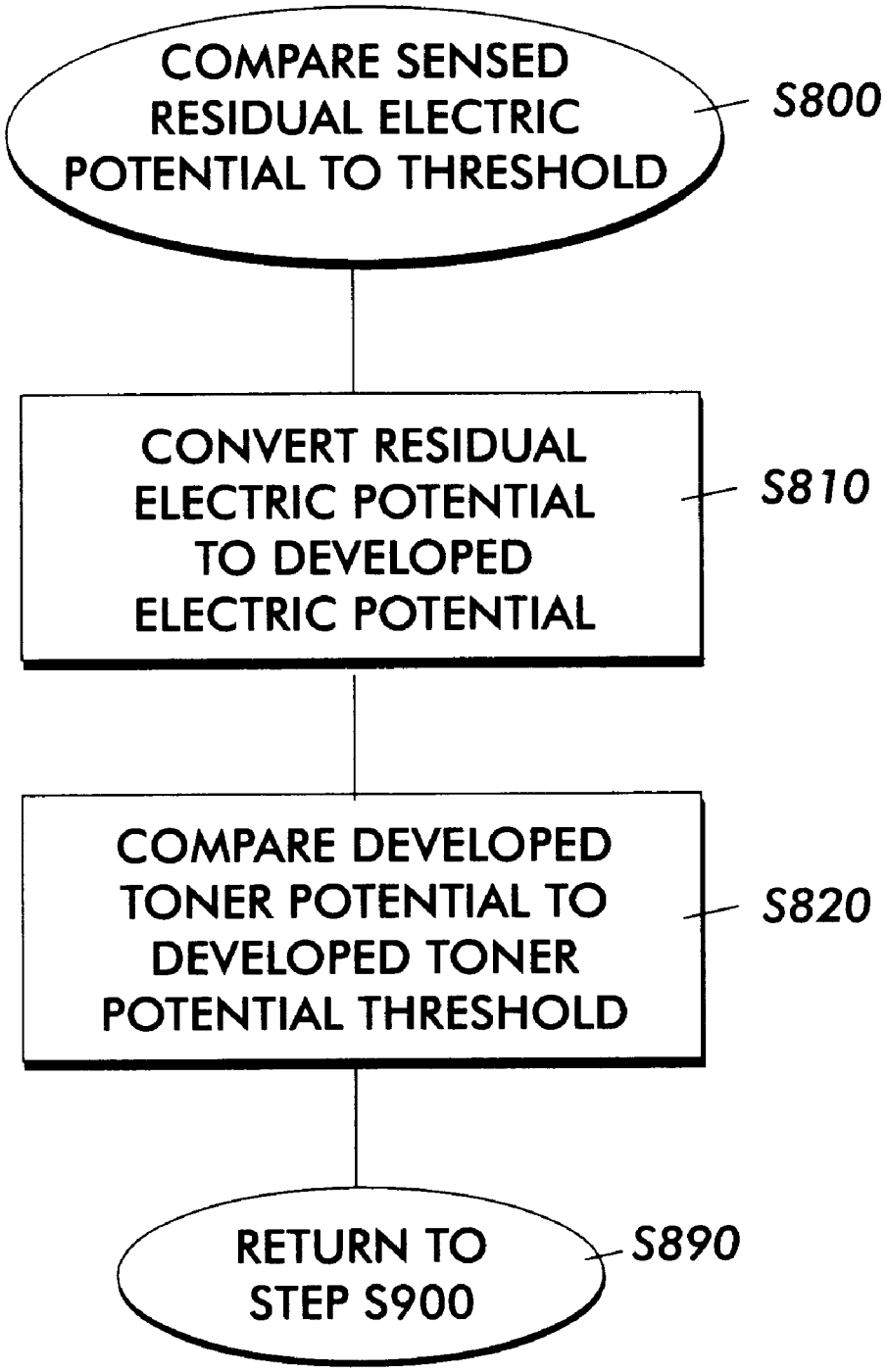
FIG. 7 is a flowchart outlining in greater detail a first exemplary embodiment of the step of comparing the sensed residual electric potential to a threshold.

FIG. 7 is a flowchart outlining in greater detail a first exemplary embodiment of the step of comparing the sensed residual electric potential to a threshold. As shown in FIG. 7, beginning in step S800, control continues to step S810, where the residual electric potential for each test patch is converted to a developed toner potential. Then, in step S820, the developed toner potential for each test patch is compared to a developed toner potential threshold. Control then jumps to step S890, where control is returned to step S900.

Figure 8:
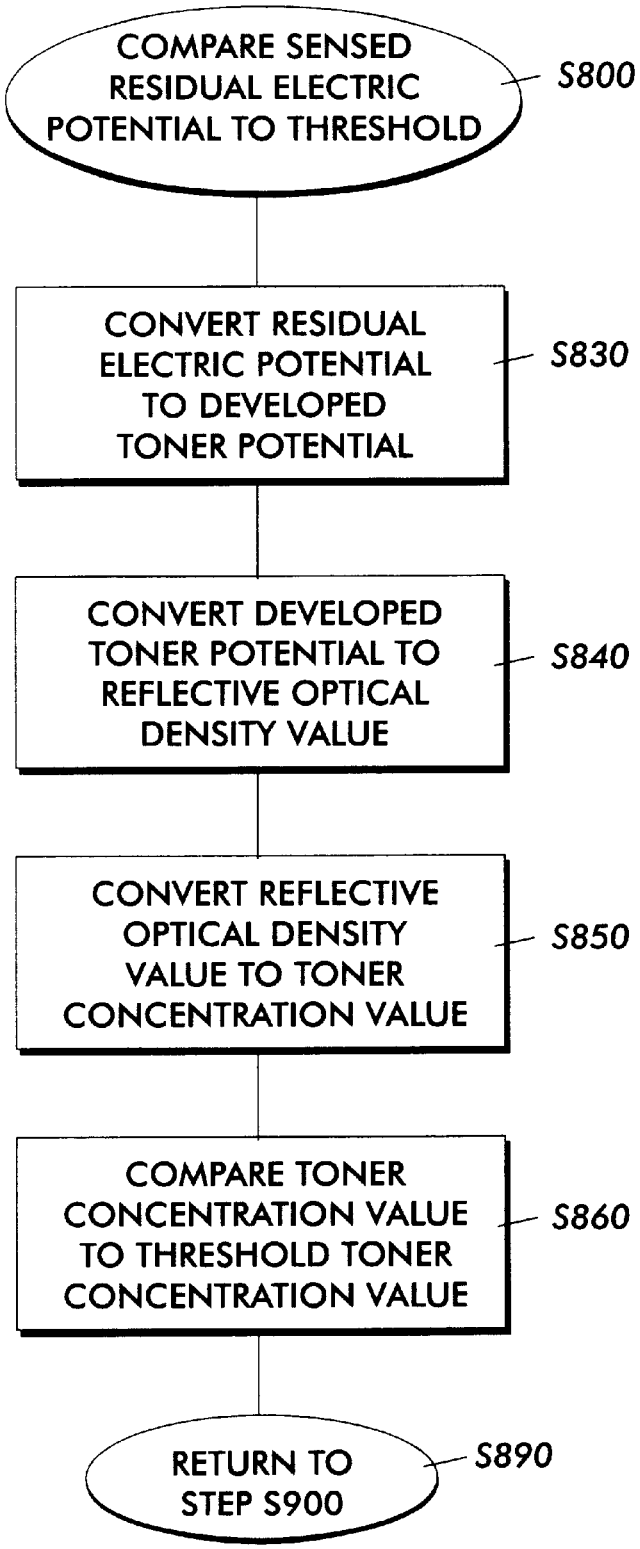
FIG. 8 is a flowchart outlining in greater detail a second exemplary embodiment of the step of comparing the sensed residual electric potential to the threshold.

FIG. 8 is a flowchart outlining in greater detail a second exemplary embodiment of the step of comparing the sensed residual electric potential to the threshold. As shown in FIG. 8, again beginning in step S800, control continues to step S830, where the residual electric potential for each test patch is converted to a developed toner potential. Then, in step S840, the developed toner potential for each test patch is converted to a reflective optical density value, based on a relationship between the developed toner potential and the reflective optical density, such as that shown in FIG. 4. Next, in step S850, the reflective optical density for each test patch is converted to a toner solids concentration value, based on a relationship between the reflective optical density and the toner solids concentration, such as that shown in FIG. 5. Control then continues to step S860.

In step S860, the toner solids concentration value for each test patch is compared to a toner solids concentration threshold. Control then jumps to step S890, where control is returned to step S900.

As shown in FIGS. 2 and 3, the toner solids concentration control system 200 is preferably implemented on a programmed microprocessor or microcontroller and peripheral integrated circuit elements. However, the toner solids concentration control system 200 can also be implemented using a special purpose computer, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the flowcharts shown in FIGS. 6–8, can be used to implement the toner solids concentration control system 200.

The memory 230 can be implemented using RAM, a floppy disk and disk drive, a writable optical disk and disk drive, a hard drive, flash memory or the like. Non-alterable portion of the memory 230 can be implemented using a ROM, a PROM, an EPROM, an EEPROM, an optical disk, such as a CD-ROM, CD-RW or DVD-ROM, and disk drive or the like.

The foregoing description of the invention is illustrative, and variations in configuration and implementation will occur to persons skilled in the art. For instance, while the invention has been described with respect to a liquid printing system, dry toner, monochrome, color and other printing systems can employ the invention to accurately measure the toner solids concentration.

Thus, while this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. A toner solids concentration control system that determines a toner solids concentration of a liquid toner comprising:

a sensor that detects a residual electric potential of a developed area on an latent image bearing member;

a controller that inputs the residual electric potential detected by the sensor and that outputs a control signal, wherein the controller comprises:

a comparing circuit that compares the detected residual electric potential to a predetermined threshold residual electric potential, and a control signal generating circuit that generates the control signal based on a difference between the detected residual electric potential and the predetermined threshold residual electric potential; and a toner solids adding device that adds a variable amount of toner to the liquid toner based on the control signal, wherein the variable amount of toner added to the liquid toner is determined by the difference between the detected residual electric potential and the predetermined threshold residual electric potential.

2. An image reproduction system, comprising:

a latent image bearing member;

a latent image developer; and the toner solids concentration control system of claim 1, wherein the sensor is positioned adjacent to the latent image bearing, and the toner solids adding device is connected to the latent image developer.

3. The image reproduction system of claim 2, wherein the latent image bearing member is one of a latent image bearing sheet, a photoreceptor drum and a photoreceptor belt.

4. A toner solids concentration control system that determines a toner solids concentration of a liquid toner comprising:

a sensor that detects a residual electric potential of a developed area on an latent image bearing member;

a controller that inputs the residual electric potential detected by the sensor and that outputs a control signal, wherein the controller comprises:

a conversion circuit that converts the detected residual electric potential to a developed toner potential based on a latent image bearing potential, a comparing circuit that compares the developed toner potential to a predetermined threshold developed toner potential, and a control signal generating circuit that generates the control signal based on the comparison result; and a toner solids adding device that adds an amount of toner to the liquid toner based on the control signal.

5. The toner solids concentration control system of claim 4, wherein the control signal generating circuit generates the control signal further based on a difference between the developed toner potential and the predetermined threshold developed toner potential.

6. The toner solids concentration control system of claim 4, wherein the latent image bearing potential is a predetermined nominal latent image bearing potential.

7. The toner solids concentration control system of claim 4, further comprising a second sensor that detects the latent image bearing potential of the developed area before the developed area is developed.

8. The toner solids concentration control system of claim 4, wherein the conversion circuit comprises a lookup table.

9. The toner solids concentration control system of claim 4, wherein the conversion circuit comprises a circuit implementing a mathematical relationship between the detected residual electric potential and the developed toner potential.

10. A toner solids concentration control system that determines a toner solids concentration of a liquid toner comprising:

a sensor that detects a residual electric potential of a developed area on an latent image bearing member;

a controller that inputs the residual electric potential detected by the sensor and that outputs a control signal, wherein the controller comprises:

a first conversion circuit that converts the detected residual electric potential to a developed toner potential based on a latent image bearing potential, a second conversion circuit that converts the developed toner potential to a current toner concentration value, a comparing circuit that compares the current toner solids concentration value to a predetermined threshold toner solids concentration value, and a control signal generating circuit that generates the control signal based on the comparison result; and a toner solids adding device that adds an amount of toner to the liquid toner based on the control signal.

11. The toner solids concentration control system of claim 10, wherein the control signal generating circuit generates the control signal further based on a difference between the current toner solids concentration value and the predetermined threshold toner solids concentration value.

12. The toner solids concentration control system of claim 10, wherein the latent image bearing potential is a predetermined nominal latent image bearing potential.

13. The toner solids concentration control system of claim 10, further comprising a second sensor that detects the latent image bearing potential of the developed area before the developed area is developed.

14. The toner solids concentration control system of claim 10, wherein the first conversion circuit comprises a lookup table.

15. The toner solids concentration control system of claim 10, wherein the first conversion circuit comprises a circuit implementing a mathematical relationship between the detected residual electric potential and the developed toner potential.

16. The toner solids concentration control system of claim 10, wherein the second conversion circuit comprises a lookup table.

17. The toner solids concentration control system of claim 10, wherein the second conversion circuit comprises a circuit implementing a mathematical relationship between the developed toner potential and the current toner solids concentration value.

18. The toner solids concentration control system of claim 10, wherein the second conversion circuit comprises:

a first conversion subcircuit that converts the developed toner potential to a reflective optical density value; and a second conversion subcircuit that converts the reflective optical density value to the current toner solids concentration value.

19. The toner solids concentration control system of claim 18, wherein the first conversion subcircuit comprises a lookup table.

20. The toner solids concentration control system of claim 18, wherein the second conversion subcircuit comprises a lookup table.

21. The toner solids concentration control system of claim 18, wherein the first conversion subcircuit comprises a circuit implementing a mathematical relationship between the developed toner potential and the reflective optical density value.

22. The toner solids concentration control system of claim 18, wherein the second conversion subcircuit comprises a circuit implementing a mathematical relationship between the reflective optical density and the current toner solids concentration value.

23. A method for detecting a toner solids concentration of a liquid toner, comprising:

detecting a residual electric potential of a developed area on an latent image bearing member; and adding an amount of toner to the liquid toner based on the detected residual electric potential, comprising:

comparing the detected residual electric potential to a predetermined threshold residual electric potential;

determining the amount of toner to add to the liquid toner based on the comparison result; and adding the determined amount of toner to the liquid toner.

24. The method of claim 23, wherein determining the amount of toner to add to the liquid toner further comprises basing the determined amount of toner on a difference between the detected residual electric potential and the predetermined threshold residual electric potential.

25. A method for detecting a toner solids concentration of a liquid toner, comprising:

detecting a residual electric potential of a developed area on an latent image bearing member; and adding an amount of toner to the liquid toner based on the detected residual electric potential, comprising:

converting the detected residual electric potential to a developed toner potential based on a latent image bearing potential, comparing the developed toner potential to a predetermined threshold developed toner potential, determining the amount of toner to add to the liquid toner based on the comparison result, and adding the determined amount of toner to the liquid toner.

26. The method of claim 25, wherein determining the amount of toner to add to the liquid toner further comprises basing the determined amount of toner on a difference between the developed toner potential and the predetermined threshold developed toner potential.

27. The method of claim 25, wherein converting the detected residual electric potential to a developed toner potential based on the latent image bearing potential comprises subtracting the detected residual electric potential from a predetermined nominal latent image bearing potential.

28. The method of claim 25, wherein converting the detected residual electric potential to a developed toner potential based on the latent image bearing potential comprises:

detecting the latent image bearing potential of the developed area before the developed area is developed; and subtracting the detected residual electric potential from the detected latent image bearing potential.

29. A method for detecting a toner solids concentration of a liquid toner, comprising:

detecting a residual electric potential of a developed area on an latent image bearing member; and adding an amount of toner to the liquid toner based on the detected residual electric potential, comprising:

converting the detected residual electric potential to a developed toner potential based on a latent image bearing potential, converting the developed toner potential to a current toner concentration value, comparing the current toner solids concentration value to a predetermined threshold toner solids concentration value, determining the amount of toner to add to the liquid toner based on the comparison result, and adding the determined amount of toner to the liquid toner.

30. The method of claim 29, wherein determining the amount of toner to add to the liquid toner further comprises basing the determined amount of toner on a difference between the current toner solids concentration value and the predetermined threshold toner solids concentration value.

31. The method of claim 29, wherein converting the detected residual electric potential to a developed toner potential based on the latent image bearing potential comprises subtracting the detected residual electric potential from a predetermined nominal latent image bearing potential.

32. The method of claim 29, wherein converting the detected residual electric potential to a developed toner potential based on the latent image bearing potential comprises:

detecting the latent image bearing potential of the developed area before the developed area is developed; and subtracting the detected residual electric potential from the detected latent image bearing potential.

33. The method of claim 29, wherein converting the developed toner potential to a current toner concentration value comprises:

converting the developed toner potential to a reflective optical density value; and converting the reflective optical density value to the current toner solids concentration value.

34. A toner solids concentration control system that determines a toner solids concentration of a liquid toner comprising:

means for detecting a residual electric potential of a developed area on latent image bearing means;

control means for inputting the residual electric potential detected by the sensor and that outputting a control signal, wherein the control means comprises:

means for comparing the detected residual electric potential to a predetermined threshold residual electric potential, and means for generating the control signal based on a difference between the detected residual electric potential and the predetermined threshold residual electric potential; and means for adding a variable amount of toner to the liquid toner based on the control signal, wherein the variable amount of toner added to the liquid toner is determined by the difference between the detected residual electric potential and the predetermined threshold residual electric potential.

35. An image reproduction system, comprising:

the latent image bearing means for bearing a latent electrostatic image;

latent image developing means for developing the latent electrostatic image on the latent image bearing means using the liquid toner; and the toner solids concentration control system of claim 34, wherein the means for detecting is positioned adjacent to the latent image bearing means, and the means for adding the toner solids is connected to the latent image developing means.

36. The image reproduction system of claim 35, wherein the latent image bearing means is one of a latent image bearing sheet, a photoreceptor drum and a photoreceptor belt.

37. A toner solids concentration control system that determines a toner solids concentration of a liquid toner comprising:

means for detecting a residual electric potential of a developed area on latent image bearing means;

control means for inputting the residual electric potential detected by the sensor and that outputting a control signal, wherein the control means comprises:

means for converting the detected residual electric potential to a developed toner potential based on a latent image bearing potential of the latent image bearing means;

means for comparing the developed toner potential to a predetermined threshold developed toner potential; and means for generating the control signal based on the comparison result; and means for adding an amount of toner to the liquid toner based on the control signal.

38. The toner solids concentration control system of claim 37, wherein the means for generating the control signal further generates the control signal based on a difference between the developed toner potential and the predetermined threshold developed toner potential.

39. The toner solids concentration control system of claim 37, wherein the latent image bearing potential is a predetermined nominal latent image bearing potential.

40. The toner solids concentration control system of claim 37, further comprising means for detecting the latent image bearing potential of the developed area before the developed area is developed.

41. The toner solids concentration control system of claim 37, wherein the means for converting comprises a lookup table.

42. The toner solids concentration control system of claim 37, wherein the means for converting comprises a circuit implementing a mathematical relationship between the detected residual electric potential and the developed toner potential.

43. An image reproduction system, comprising:

a latent image bearing member;

a latent image developer; and the toner solids concentration control system of claim 4, wherein the sensor is positioned adjacent to the latent image bearing, and the toner solids adding device is connected to the latent image developer.

44. The image reproduction system of claim 43, wherein the latent image bearing member is one of a latent image bearing sheet, a photoreceptor drum and a photoreceptor belt.

45. An image reproduction system, comprising:

a latent image bearing member;

a latent image developer; and the toner solids concentration control system of claim 10, wherein the sensor is positioned adjacent to the latent image bearing, and the toner solids adding device is connected to the latent image developer.

46. The image reproduction system of claim 45, wherein the latent image bearing member is one of a latent image bearing sheet, a photoreceptor drum and a photoreceptor belt.

47. An image reproduction system, comprising:

the latent image bearing means for bearing a latent electrostatic image;

latent image developing means for developing the latent electrostatic image on the latent image bearing means using the liquid toner; and the toner solids concentration control system of claim 37, wherein the means for detecting is positioned adjacent to the latent image bearing means, and the means for adding the toner solids is connected to the latent image developing means.

48. The image reproduction system of claim 47, wherein the latent image bearing means is one of a latent image bearing sheet, a photoreceptor drum and a photoreceptor belt.

* * * * *